US006223778B1

(12) United States Patent
Bucher et al.

(10) Patent No.: US 6,223,778 B1
(45) Date of Patent: May 1, 2001

(54) APPARATUS FOR THE INSERTION OF WEFT THREADS FOR A SERIES SHED WEAVING MACHINE

(75) Inventors: Robert R. Bucher, deceased, late of Frick, by Nicla Bucher; Hans Peter, Winterthur; Godert De Jager, Volketswil, all of (CH)

(73) Assignee: Sulzer Rueti AG, Rueti (CH)

( * ) Notice: Subject to any disclaimer, the term of this patent is extended or adjusted under 35 U.S.C. 154(b) by 0 days.

(21) Appl. No.: 09/375,922

(22) Filed: Aug. 17, 1999

(30) Foreign Application Priority Data

Aug. 19, 1998 (EP) ..... 98810806

(51) Int. Cl.[7] ..... D03D 47/30; D03D 47/26
(52) U.S. Cl. ..... 139/28
(58) Field of Search ..... 139/28, 435.1, 139/194, 450

(56) References Cited

U.S. PATENT DOCUMENTS 5,146,955 * 9/1992 Steiner et al. ..... 139/28
5,437,313 * 8/1995 Christe ..... 139/28
5,439,037 * 8/1995 Christe ..... 139/28
5,937,913 * 8/1999 Christe ..... 139/28

FOREIGN PATENT DOCUMENTS 0143860 6/1985 (EP) .
0433216 A1 6/1991 (EP) .
0685584 A1 12/1995 (EP) .

* cited by examiner

*Primary Examiner*—Andy Falik
(74) *Attorney, Agent, or Firm*—Townsend and Townsend and Crew LLP

(57) ABSTRACT

A weft insertion apparatus for a series shed weaving machine contains a unit of fixed location with a plurality of passages (21) and with a plurality of nozzles (25) and a unit which rotates with the weaving rotor (1) with a plurality of nozzles (12) to draw off the weft threads which are supplied to the passages and to shoot them successively into the shed. This apparatus enables the insertion of weft threads of different kinds in rapid succession.

11 Claims, 4 Drawing Sheets

Fig.5
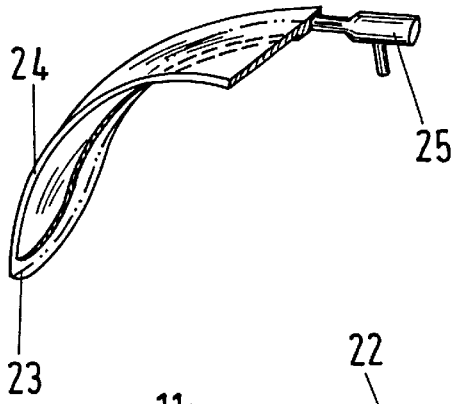
Fig.6
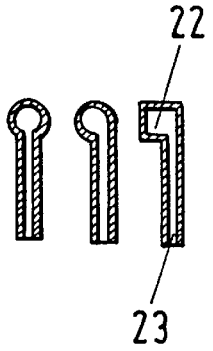
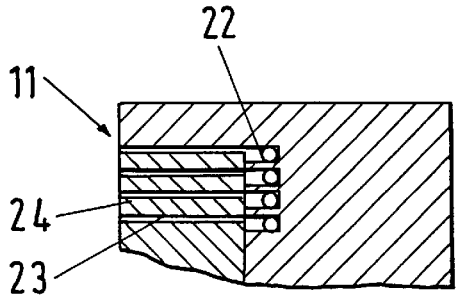
Fig.4
Fig.8
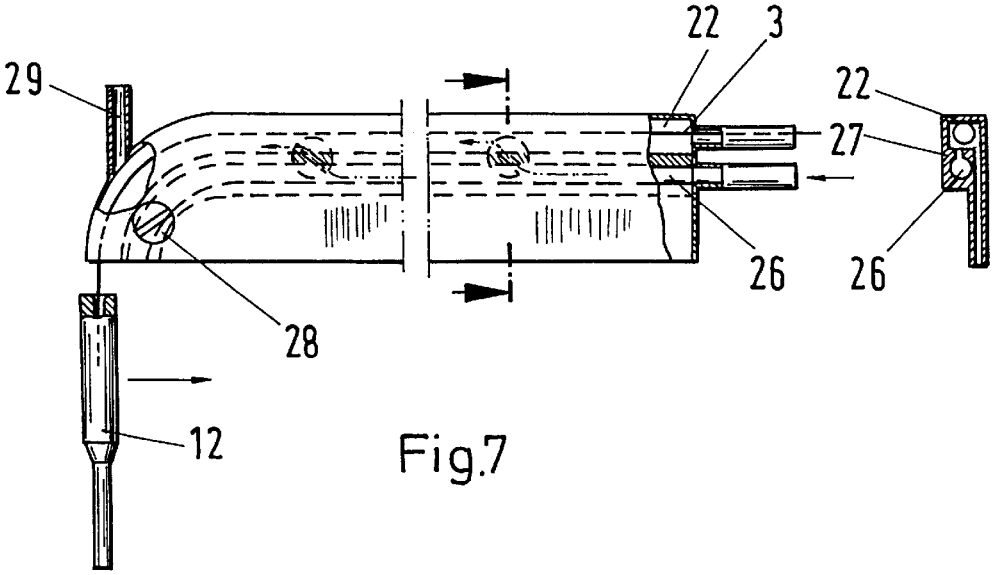
Fig.7

APPARATUS FOR THE INSERTION OF WEFT THREADS FOR A SERIES SHED WEAVING MACHINE

The present invention relates to an apparatus for the insertion of weft threads for a series shed weaving machine with an air nozzle system and to a series shed weaving machine with an apparatus of this kind.

BACKGROUND OF THE INVENTION

An apparatus is described in EP-A-0 433 216 for the distribution of the weft threads from a thread supply device to plurality a of insertion passages of a weaving rotor of a series shed weaving machine which contains a stationary part and a part which rotates with the weaving rotor which have a common parting and sealing face in a rotationally symmetrical surface and via which the transfer of the weft thread takes place. In the stationary part passages are formed in a known arrangement and nozzles are provided for each passage in order to draw off the weft thread from a device which supplies the weft threads and to introduce it into the respective passage. In the part which rotates with the weaving rotor, acceptor passages are formed in a known arrangement and shoot-in tubes are provided in order to shoot the weft threads which are supplied by the nozzles into the weft insertion passages which are formed at the weaving rotor.

The disadvantages of this apparatus are essentially to be seen in that the gap between the stationary part and the part which rotates with the weaving rotor is made very narrow in order to ensure the forwarding of the weft threads to the weaving rotor, in that the nozzle which is associated with each passage must drive the beginning of the weft thread through the passage up to the relay nozzles in the weaving rotor; and in that as a result of the constitution of the yarn, thread parts, e.g. fibrils, can penetrate into the gap between the stationary part and the part which rotates with the weaving rotor. A substantial restriction of the kinds of yarn which can be woven on the weaving machine results from this.

SUMMARY OF THE INVENTION

The object of the invention is to improve an apparatus of this kind.

This object is satisfied in accordance with the invention by the characterising features of claim 1.

The invention will be described in the following with reference to the accompanying drawings.

DESCRIPTION OF THE DRAWINGS

Shown are:

FIG. 4 shows a cross-sectional view along the line IV—IV in FIG. 3;

FIG. 5 is a first embodiment of an element with a passage in accordance with the invention for the supply of a weft thread in a spatial illustration;

FIG. 6 shows cross-sectional views of passages;

FIG. 7 is a modified embodiment of an element in accordance with FIG. 5 in a stretched illustration;

FIG. 8 shows a cross-sectional view of the passage in accordance with FIG. 7;

DESCRIPTION OF THE PREFERRED EMBODIMENTS

Figure 1:
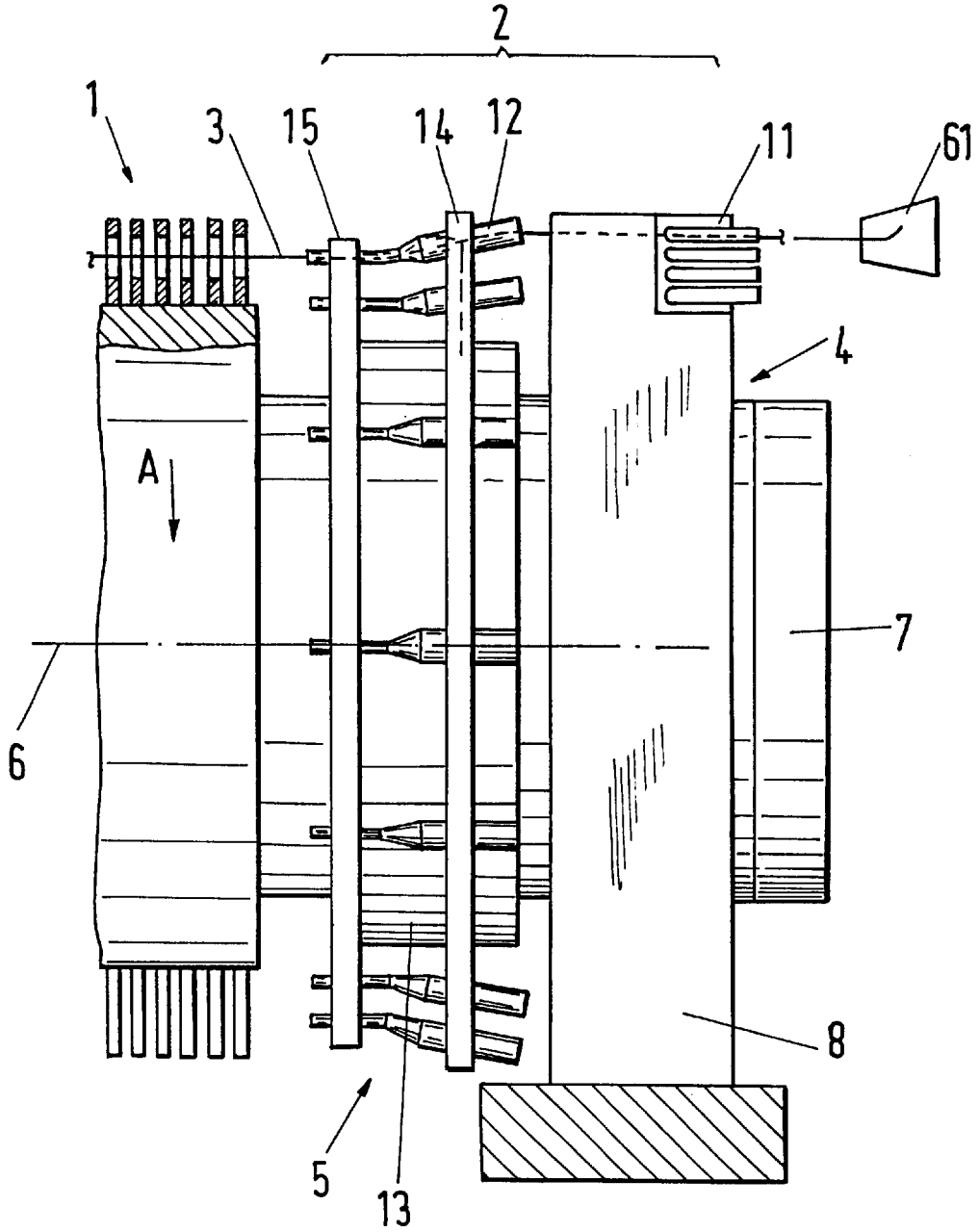
FIG. 1 is a side view of a first embodiment of an apparatus in accordance with the invention.

FIG. 1 shows a weaving rotor 1 and an apparatus 2 in accordance with the invention for the insertion of weft threads 3 for a series shed weaving machine. In series shed weaving machines the weft threads are, as is known, continually drawn off from a weft thread supply (not illustrated) and fed by means of air into the weft insertion passages at the weaving rotor 1 in staggered succession.

The apparatus 2 comprises a unit 4 of fixed location for the supplying of the weft threads, a unit 5 for feeding in the weft threads which rotates synchronously with the weaving rotor 1 about the axis of rotation 6 in the direction of the arrow A and a rotary slide valve 7 for the supplying of the air. The unit 4 for the supplying of the weft threads has a holder 8 for an arrangement 11 of passages. The unit 5 for the shooting in of the weft threads has twelve injector nozzles 12 which are arranged at a cylindrical carrier part 13. The carrier part contains a first ring-shaped section 14 for the nozzle bodies and a second ring-shaped section 15 for the nozzle mouths. It is pointed out that the nozzles can also be arranged in a common section and that the number of nozzles can vary.

Figure 3:
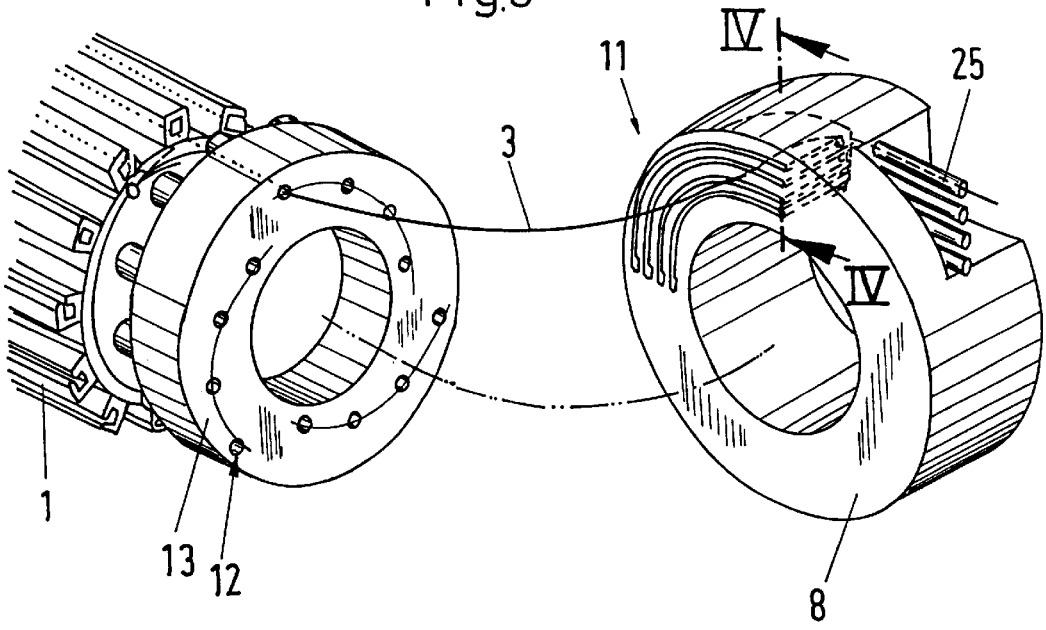
FIG. 3 is a schematic illustration of the first embodiment of the stationary and the rotating unit in accordance with FIG. 1 at the end of the weft insertion.
Figure 2:
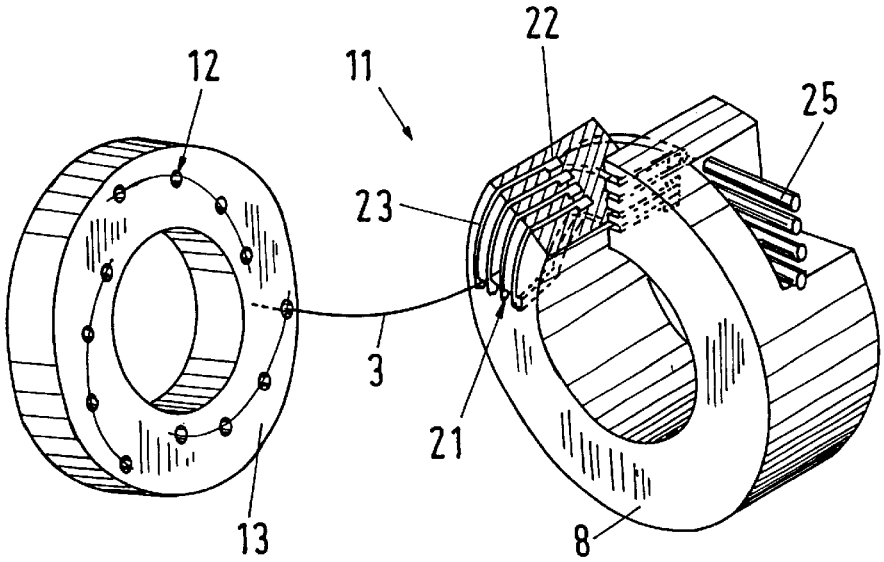
FIG. 2 is a schematic illustration of the stationary and the rotating unit in accordance with FIG. 1 at the beginning of the weft insertion.

Reference is made to FIGS. 2 to 4. FIGS. 2 and 3 are schematic illustrations, with the apparatus 2 being illustrated in a folded out view, and show the situation at the beginning of the insertion (FIG. 2) and at the end of the insertion of a weft thread 3 (FIG. 3). The arrangement 11 comprises four passages 21 which form a circular arc and which lie concentrically one above the other, with the ends lying on a line. Each passage consists of a transport passage 22 and a draw-out passage 23, with the transport passage having a free width which is greater by a large factor than the free width of the draw-out passage. The openings of the transport passages lie on concentric partial circles. As FIG. 4 shows, the passages 22, 23 are formed by means of arcuate parts 24 which are mounted on the holder 8 by non-illustrated means. Each passage is provided with a nozzle 25 for the supplying of a weft thread. The inlet openings of the injector nozzles 12 are arranged on concentric pitch circles, the diameter of which is equal to those of the pitch circles of the openings of the transport passages 22. The injector nozzles 12 are subdivided into three groups of four nozzles each, with one nozzle of each group in each case lying on a pitch circle. The openings of the injector nozzles 12 lie on a common pitch circle. Scissors S cut weft thread 3 as the thread rotates into scissors S.

FIGS. 5 and 6 show, the passages 21 can be formed by means of individual elements which are arranged in the holder 8. The passages can have different cross-sections.

FIGS. 7 and 8 show a modified embodiment of the element in accordance with FIGS. 5 and 6, which shows the passage in a stretched illustration. For the transporting of certain yarns it can be advantageous to provide a second passage 26 next to the transport passage 22 in order to improve the guidance of a weft thread in the transport passage. For this, auxiliary nozzles 27 and a restrictor valve 28 are provided in the partition wall of the passages 22, 26. It can be advantageous to provide a further nozzle 29 in order to improve the transfer of the weft thread from the transport passage 22 to the injector nozzle 12.

Figure 9:
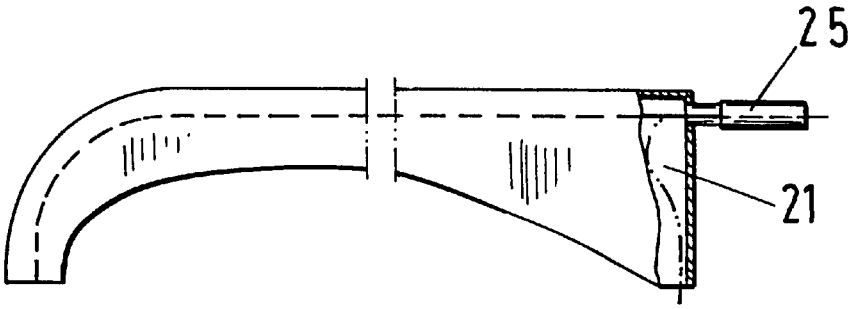
FIG. 9 is a second modified embodiment of an element in accordance with FIG. 5, in a stretched illustration.

FIG. 9 shows a modified embodiment of the element in accordance with FIG. 5, which shows the element in a stretched illustration. In order to reduce the stressing of the weft thread during the insertion, i.e. during the drawing out from the element, it can be advantageous to design the depth of the passage (21) differently.

Figure 10:
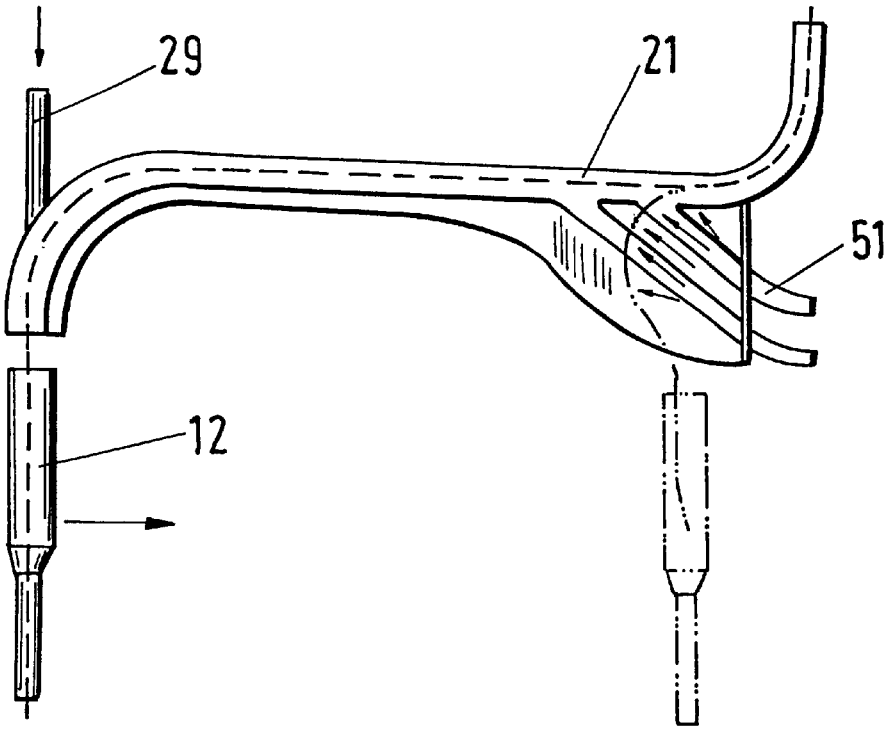
FIG. 10 is a third embodiment of an element with a passage in accordance with the invention for the supply of a weft thread, in a stretched illustration.

FIG. 10 shows a third embodiment of an element for a unit for the supplying of a weft thread. In order to improve the supplying of the weft thread, i.e. to ensure the drawing off of the weft thread through the injector nozzle 12, auxiliary nozzles 51 are provided which open into the transport passage 22 in order to stretch the weft thread in the transport passage.

The apparatus contains a unit of fixed location with a plurality of passages 21 and with a plurality of nozzles 25 and a unit which rotates with the weaving rotor 1 with a plurality of nozzles 12 which are intended to draw off the weft threads which are supplied to the passages and to shoot them successively into the shed.

This apparatus ensures the insertion of weft threads of different kinds and embodiments.

What is claimed is:

1. Apparatus for the insertion of weft threads into a series shed weaving machine comprising:

a rotating weaving rotor having weft insertion passages;

a rotating nozzle unit having a plurality of injector nozzles for rotating synchronously with the rotating weaving rotor and inserting weft threads into the weft insertion passages;

a unit of fixed position with a plurality of passages;

a valve for supplying air under pressure to the plurality of passages of the unit of fixed position; and apparatus for supplying weft threads to the weft insertion passages whereby the air under pressure entrains the weft threads through the passages to the rotating injector nozzles for insertion of the weft to the weft insertion passages of the rotating weaving rotor.

2. The apparatus for the insertion of weft threads into a series shed weaving machine according to claim 1 wherein:

the unit of fixed position has a plurality of second nozzles communicated to the plurality of passages of the unit of fixed position.

3. The apparatus for the insertion of weft threads into a series shed weaving machine according to claim 1 wherein:

the plurality of passages of the unit of fixed position are arranged in the shape of an arc and are substantially concentric.

4. The apparatus for the insertion of weft threads into a series shed weaving machine according to claim 1 wherein:

each of the passages of the unit of fixed position includes a transport passage to supply weft thread to the passages and a draw-out passage to supply weft thread to the nozzles.

5. The apparatus for the insertion of weft threads into a series shed weaving machine according to claim 4 wherein:

the transport passage has a cross sectional dimension which exceeds the draw-out passage cross sectional dimension.

6. The apparatus for the insertion of weft threads into a series shed weaving machine according to claim 3 wherein:

the plurality of passages of the unit of fixed position are arranged in the shape of an arc which vary in cross sectional dimension across the arc.

7. The apparatus for the insertion of weft threads into a series shed weaving machine according to claim 2 wherein:

the unit of fixed position integrally attaches the plurality of passages and second nozzles communicated to the plurality of passages.

8. The apparatus for the insertion of weft threads into a series shed weaving machine according to claim 1 wherein:

the unit of fixed position has four passages.

9. The apparatus for the insertion of weft threads into a series shed weaving machine according to claim 1 wherein:

the unit of fixed position with a plurality of passages includes a plurality of passages for forwarding the weft thread and auxiliary passages for supplying air to the plurality of passages for forwarding the weft thread.

10. The apparatus for the insertion of weft threads into a series shed weaving machine according to claim 1 wherein:

the rotating nozzle unit has twelve injector nozzles.

11. The apparatus for the insertion of weft threads into a series shed weaving machine according to claim 1 wherein:

the unit of fixed position with a plurality of passages includes four nozzles with each nozzle having a different pitch with respect to the rotating nozzle unit.

* * * * *